US009961960B2

(12) United States Patent
Desmarais

(10) Patent No.: US 9,961,960 B2
(45) Date of Patent: May 8, 2018

(54) FOOTWEAR HAVING CUSHIONING BETWEEN SOLE AND UPPER

(71) Applicant: Richard Patrick Desmarais, Nepean, Ontario (CA)

(72) Inventor: Richard Desmarais, Nepean (CA)

( * ) Notice: Subject to any disclaimer, the term of this patent is extended or adjusted under 35 U.S.C. 154(b) by 246 days.

(21) Appl. No.: 14/910,284

(22) PCT Filed: May 28, 2014

(86) PCT No.: PCT/CA2014/050497

§ 371 (c)(1),
(2) Date: Feb. 5, 2016

(87) PCT Pub. No.: WO2015/017920

PCT Pub. Date: Feb. 12, 2015

(65) Prior Publication Data

US 2016/0174658 A1 Jun. 23, 2016

(30) Foreign Application Priority Data

Aug. 5, 2013 (CA) ..... 2822759

(51) Int. Cl.
*A43B 13/20* (2006.01)
*A43B 13/18* (2006.01)
*A43B 13/14* (2006.01)

(52) U.S. Cl.
CPC ..... *A43B 13/203* (2013.01); *A43B 13/14* (2013.01); *A43B 13/181* (2013.01); *A43B 13/186* (2013.01); *A43B 13/20* (2013.01)

(58) Field of Classification Search
CPC ..... A43B 13/203; A43B 13/206; A43B 13/20; A43B 13/187
See application file for complete search history.

(56) References Cited

U.S. PATENT DOCUMENTS 4,936,028 A * 6/1990 Posacki ..... A43B 13/36 36/15
5,381,609 A * 1/1995 Hieblinger ..... A43C 11/00 36/50.1
5,477,626 A * 12/1995 Kwon ..... A43B 13/203 36/3 B
5,598,645 A * 2/1997 Kaiser ..... A43B 13/00 36/28

(Continued)

FOREIGN PATENT DOCUMENTS

CA 2538931 9/2006
CN 203058526 7/2013

(Continued)

OTHER PUBLICATIONS

PCT/CA2014/050497 International Search Report, dated Jul. 25, 2014.

*Primary Examiner* — Jila M Mohandesi

(57) ABSTRACT

To provide cushioning and stability, a shoe has a sole section and an upper, the sole section comprising an outsole having a lower surface for contacting the ground, an insole and cushioning between the insole and the outsole. In addition, the shoe has a plurality of ligatures interconnecting the insole and the outsole, respectively, by way of the cushioning section. The ligatures control movement of the shoe upper relative to the outsole in at least two directions.

19 Claims, 8 Drawing Sheets

(56) References Cited

U.S. PATENT DOCUMENTS

| | | | | |
|---|---|---|---|---|
| 5,813,146 | A * | 9/1998 | Gutkowski | A43B 3/26 36/93 |
| 6,385,864 | B1 * | 5/2002 | Sell, Jr. | A43B 13/181 36/29 |
| 7,210,249 | B2 * | 5/2007 | Passke | A43B 7/081 36/29 |
| 7,540,100 | B2 * | 6/2009 | Pawlus | A43B 13/141 36/102 |
| 7,818,896 | B2 * | 10/2010 | Hsieh | A43B 1/0036 36/29 |
| 7,870,681 | B2 | 1/2011 | Meschter | |
| 8,312,646 | B2 | 11/2012 | Meschter et al. | |
| 9,144,268 | B2 * | 9/2015 | Swigart | A43B 13/206 |
| 9,491,983 | B2 * | 11/2016 | Rushbrook | A43B 13/141 |
| 2005/0268489 | A1 | 12/2005 | Austin | |
| 2010/0139122 | A1 * | 6/2010 | Zanatta | A43B 3/26 36/97 |
| 2011/0025159 | A1 | 2/2011 | Wade | |
| 2011/0041359 | A1 | 2/2011 | Dojan et al. | |
| 2011/0131831 | A1 * | 6/2011 | Peyton | A43B 13/20 36/29 |
| 2011/0271552 | A1 | 11/2011 | Peyton | |
| 2012/0023778 | A1 | 2/2012 | Dojan et al. | |
| 2013/0025075 | A1 | 1/2013 | Meschter et al. | |

FOREIGN PATENT DOCUMENTS

| | | |
|---|---|---|
| WO | 9405177 | 3/1994 |
| WO | 0170062 | 9/2001 |
| WO | 2009143000 | 11/2009 |

* cited by examiner

FOOTWEAR HAVING CUSHIONING BETWEEN SOLE AND UPPER

CROSS-REFERENCE TO RELATED APPLICATION(S)

This application claims priority to Canadian patent application no. 2,822,759, filed on Aug. 5, 2013. The contents of said application are incorporated by reference herein.

TECHNICAL FIELD

This invention relates to shoes such as athletic shoes having a cushioning layer such as an air bladder between the sole and the shoe upper.

BACKGROUND

For convenience, in this patent specification, the term "shoe" will be used for an article of footwear that includes a cushioned sole. Examples include athletic shoes such as running shoes, soccer/football shoes, basketball shoes, baseball shoes, cross-training shoes, cycling shoes or tennis shoes. The term can also refer to hiking boots, dress shoes, loafers, sandals, work boots and specialized footwear that includes a cushioned sole. Moreover, in the context of this specification, the term "shoe" embraces articles of footwear having a sole assembly comprising an outsole which contacts the ground, an insole which usually will be the uppermost permanent part of the sole and a cushioning section intermediate the insole and the outsole. Usually the insole will be attached by its periphery to the shoe upper and may be covered by a replaceable insert of foam rubber or the like.

The term "cushioning" refers to an insert within the sole assembly that cushions impact, such as an air bladder or a foam insert.

Examples of shoes that have intermediate cushioning of one form or another between the outsole and the insole are disclosed in US patent documents numbers U.S. Pat. Nos. 7,870,681; 8,312,646; 2011/0041359; 2012/0023778; 2011/0025159; 2013/0025075 and the present inventor's own Canadian patent number 2,538,931.

In use, and in particular athletic use or other uses that subject shoes to high levels of forces, the cushioning portion of the shoe may be subjected to lateral, longitudinal (i.e. axial or fore/aft), compressive and tensile forces, either unidirectionally or in various combinations simultaneously or in rapid succession. For example, multiple forces on the sole may occur as the wearer stops, starts, changes direction, jumps, and so on. Also, sports shoes used in, for example, basketball or other sports involving rapid changes in direction and stopping abruptly may stretch the material of the shoe upper and lead to problems with stability and load distribution of the shoe. In US2013/0025075, US2012/0023778 and others, these problems have been addressed by, in effect, a mesh or lattice-work of intersecting strands either embedded into or attached securely to the outside of the sidewalls of the shoe upper. The strands interconnect an area of the shoe upper adjacent the lace eyelets and an area of the shoe upper at or adjacent the outsole and/or to the outsole itself. The intersecting sets of strands are said to limit stretching of the side walls of the shoe upper.

Stability and load distribution problems may be particularly significant in shoes which have a relatively thick and/or compliant cushioning section between the outsole and the insole. Such problems can arise with cushioning of the kind comprising an air bag or bladder or a plurality of air pockets or cells distributed about the sole of the shoe between the outsole and the insole. Both kinds of air cushioning members may be susceptible to lateral or axial instability which can lead to lateral "roll over" of the shoe, lateral instability or other problems during use. Instability can also arise when the cushion is subjected to unbalanced vertical compressive forces. Similar considerations apply to shoes which have an outsole having several segments each connected by sidewalls to a midsole of the sole section, with air or foam rubber in the cavity defined thereby. Such a shoe is marketed as a Bounce™ or Leaf Spring Bounce™ by Adidas Group.

Where a plurality of air cells are used, some stability may provided by the walls of the cells, which may comprise rubber, resilient synthetic plastics materials or the like which are designed to be somewhat rigid to reduce lateral instability. A similar solution can be provided with a monolithic bladder as the cushion.

In general, the sidewalls of air cells or air bladders should be somewhat flexible in order to allow the cell(s) or bladder to compress, so as to take advantage of the compressive properties of the air bladder. However, in the absence of means to improve stability, a flexible sidewall tends to have less lateral stability which can increase the tendency of the shoe to roll over or for the sole to be displaced laterally or axially relative to the upper when subjected to horizontal stresses (lateral or axial) or imbalanced forces. As a result of these competing requirements, shoe design often involves a trade-off or compromise between the requirements for stability and cushioning.

In some cases, a solution has been sought by incorporating strands in the sidewall of an airbladder to increase lateral stability. Although the use of strands for reinforcing the sidewalls of the shoe upper may make the shoe upper less stretchable, and air cell walls and/or hydraulic stabilizers may improve stability, the above-mentioned ways of providing cushioning and stability between an outsole and insole separated by an intermediate cushioning section, especially comprising an airbag/bladder, are not entirely satisfactory in that these structures can reduce the vertical compressibility of the sole, thereby reducing shock absorption.

An alternative means to improve stability may be provided by one or more hydraulic members as disclosed, for example, in the present inventor's Canadian patent number 2,538,931.

SUMMARY OF INVENTION

The present invention seeks to eliminate, or at least mitigate, certain disadvantages of shoes that provide a cushioning layer that is potentially subject to lateral and/or longitudinal instability, or at least provide an alternative.

One aspect of the invention relates to a shoe sole assembly having a front toe end, a rear heel end and lateral sides with a central axis extending between the front and rear ends. The assembly comprises an outsole having a lower surface for contacting the ground, an insole and cushioning between the insole and the outsole. A plurality of ligatures interconnect the insole and the outsole, respectively, by way of the cushioning section. The ligatures are tensioned and angularly oriented so as to control movement of the upper relative to the outsole. The ligatures may be oriented to control movement of the shoe upper relative to the outsole in at least two directions which may be orthogonal to each other.

At least one of said ligatures may extend through said cushioning.

The cushioning may comprise a gas bladder.

A downwardly-extending upper boss may depend from the insole for anchoring at least one of said ligatures. An upwardly-extending lower boss may be aligned with and opposing the upper boss to act as a stop member for the upper boss when the cushioning is compressed.

At least one of said ligatures may consist of a continuous member wherein opposing free ends of said ligature are anchored at an upper position and a middle portion of said ligature passes beneath said cushioning section. The free ends of said ligature may be anchored to said upper boss. The upper boss may comprise a shock absorber extension projecting downwardly to limit compression of the cushioning section.

The assembly may further comprising a rib extending across a lower surface of said cushioning section having a downwardly-facing surface for contacting said ligature to retain the middle portion of the ligature beneath the cushioning section.

The ligatures may comprise a first ligature adjacent to said toe and a second ligature adjacent to said heel.

In general, the ligatures may be angularly disposed to resist lateral displacement forces acting between the upper and sole of the shoe and unbalanced vertical compressive forces acting on said shoe. At least one of said ligatures may be oriented to angle outwardly and downwardly from an upper anchoring location adjacent to said central axis to a lower engagement location adjacent to an outer edge of said sole assembly. The downward/outward angling of the ligatures allows them to stabilize lateral movement of the sole relative to the upper. At least one of said ligatures may also extend substantially longitudinally between the front and rear ends of said shoe. At least two of the ligatures may extend in opposing directions substantially perpendicular to said central axis for purely lateral stability. At least one of said ligatures may be oriented in a direction intermediate between perpendicular and parallel to said central axis to provide stability against angled (non-perpendicular) horizontal forces acting on the shoe. The ligatures may also comprise two sets of ligatures wherein a first of said sets comprises ligatures that are anchored at or adjacent to the widest portion of the front of said shoe and a second of said sets is anchored at or adjacent to the widest portion of the rear of said shoe.

In another aspect, the cushioning layer of a shoe sole assembly comprises an air bladder and the sole assembly further comprises a pump for pressurizing the bladder wherein said pump is actuated to pump air into said bladder upon compression of said sole section. The pump may be positioned within the interior of said bladder. The pump may comprises an air inlet extending to the exterior of said sole assembly, an outlet opening into the interior of said bladder and a one-way valve within at least one of said inlet and outlet for admitting air into said bladder while preventing release of air from said bladder.

The pump body may be anchored to a lower portion of the sole assembly to extend upwardly within said bladder wherein with a gap is defined between an uppermost surface of said pump when fully extended and an upper layer of the bladder.

The invention further relates to a shoe comprising an upper and the shoe sole assembly as described herein.

The ligatures may interconnect the outsole and insole in such a way as to tend to transfer forces from one side of the outsole to the other and permit tilting of the insole (and shoe upper) relative to the outsole, thereby allowing more of the lowermost surface of the outsole to remain in contact with the ground or other surface the wearer is traversing when the wearer is changing direction, especially sideways, than would an outsole with only limiting tilting capability.

It is noted that the stiffness of the air bag will tend to limit relative movement of the shoe body and outsole, at least for lesser forces. As the lateral displacement forces increase, however, moving the upper and lower parts of the air bag longitudinally relative to each other will tend to cause the air bag to "roll". The combined action of the ligatures as a stabilizer system then becomes more important.

The midsole 28 may be provided with a plurality of ribs depending from its underside, each rib extending between a pair of holes either side of the upper boss. Each rib may have a curved profile so as to reduce the bending angle of the ligature as it passes through the hole. The curvature of the rib may help to distribute the load across the width of the lower midsole. The curved edge of each rib may be grooved to receive the ligature and reduce the likelihood of it sliding off the rib.

Various objects, features, aspects and advantages of the present invention will become more apparent from the following detailed description, taken in conjunction with the accompanying drawings, of a preferred embodiment of the invention, which description is provided by way of example only. Directional references herein such as "up", "down", "vertical" "horizontal" etc. are used purely for convenience of description, except where stated otherwise. As well, references to particular dimensions, tolerances and the like are not to be taken as limiting of the scope of the invention.

BRIEF DESCRIPTION OF DRAWINGS

In the drawings, identical or corresponding elements in the different Figures have the same reference numerals.

FIG. 1A is a side view of a shoe upper; FIG. 1B is a partial longitudinal cross-sectional view of a cushioning system between an insole of the shoe upper and an outsole the shoe; FIG. 1C is a cross-sectional view of the outsole of the shoe.

DETAILED DESCRIPTION

Figure 1A:
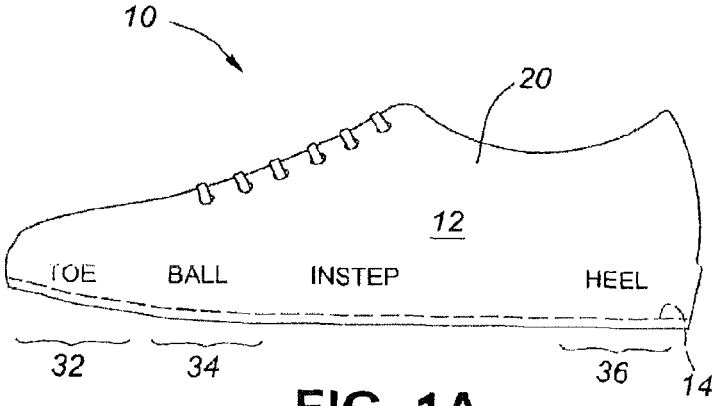
FIGS. 1A, 1B and 1C together constitute a side view of a disassembled article of footwear, specifically a shoe, embodying the invention.
Figure 1B:
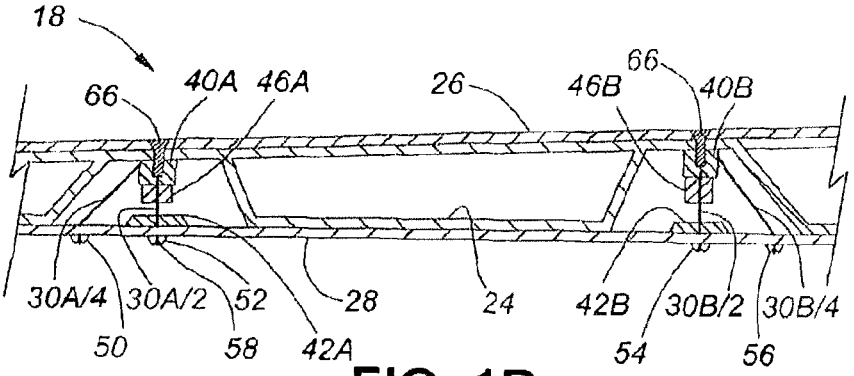
Figure 1C:
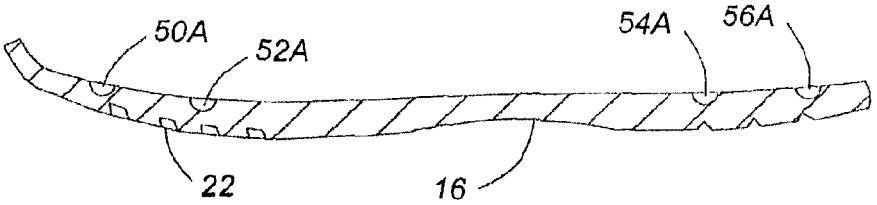

FIGS. 1A, 1B and 1C illustrate a running shoe 10 having a sole assembly according to the present invention. The shoe 10 comprises an upper body portion 12 attached to a sole assembly 11 (shown in exploded view in FIG. 3). Assembly 11 comprises an insole 14 (FIG. 1A) and an outsole 16 (FIG. 1*c*). The insole 14 and outsole 16 are spaced apart by a cushioning section 18. The insole 14 is attached at its periphery to the lower extremities of sidewalls 20 of the upper body portion 12 in a conventional way such as stitching and/or adhesive. As is common, the outsole 16 has a tread 22 on its lowermost surface which, in use, contacts the ground, and a small upturned front end. The outsole 16 may be made of conventional materials such as natural rubber, synthetic rubber, polyurethane, polyvinyl chloride or other suitable material; one example is marketed under the trade name Vibram™. The upper shoe body 12 usually will be made of natural or synthetic leather, nylon or other suitable material and may have toe and heel overlays (not shown) to provide reinforcement and support and, to some extent, contribute to the aesthetic appearance of the shoe 10. The overlays may be made of leather, nylon, or other suitable material stitched or otherwise secured to the upper shoe body 12 and may also be secured to the outsole 16 to improve security of attachment of the upper body 12.

Usually, a removable and replaceable foam rubber insert similar in shape to the insole 14, or perhaps an orthotic, would be provided in the shoe interior upon the insole 14, but is not shown for convenience of illustration.

Figures 2A, 2B, 2C, 2D:
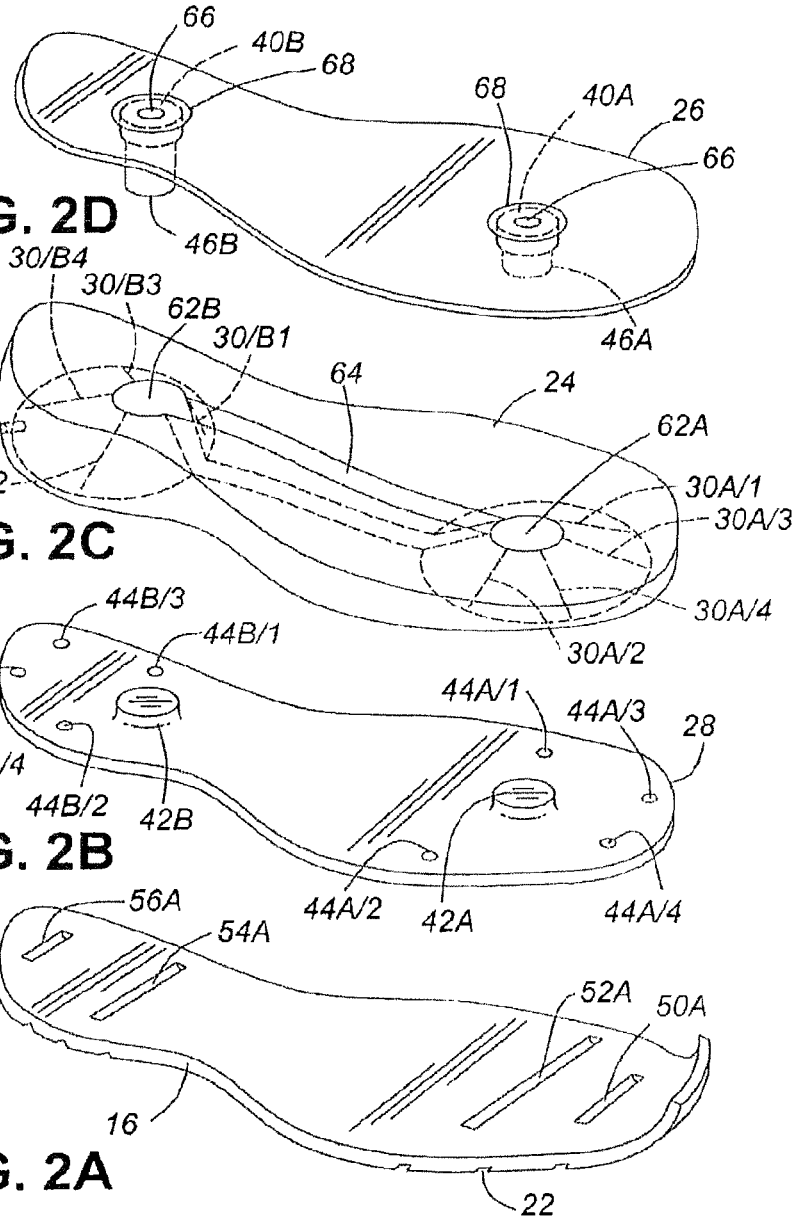
FIGS. 2A to 2D comprise an exploded view of the cushioning system and 25 outsole of the shoe of FIGS. 1A to 1C, the cushioning system shown as comprising an airbag/bladder between an upper midsole and a lower midsole.
Figure 3:
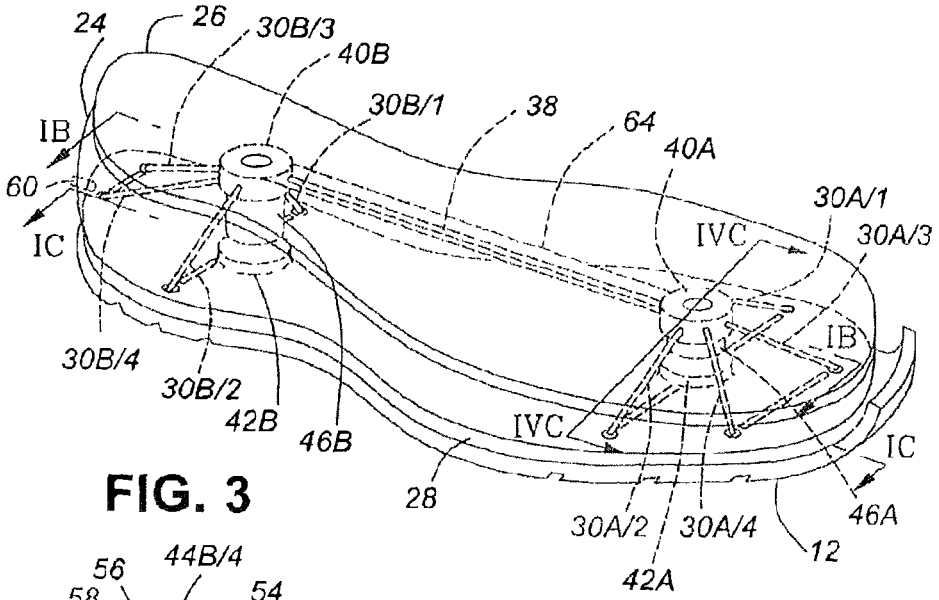
FIG. 3 is a perspective view of the assembled upper midsole, lower midsole and outsole with the interposed air bag/bladder and a plurality of ligatures interconnecting the upper midsole to the lower midsole.

As can be seen from the exploded views of FIGS. 2A to 2D and the perspective view of FIG. 3 of the assemblage of components of the outsole 16 and cushioning section 18, the components of FIGS. 2A to 2D have the same general outline so that, when assembled, they are generally vertically aligned. The cushioning section 18 includes an air bag or bladder 24 which is sandwiched between an upper midsole 26 and a lower midsole 28 within cushioning section 18. Upper midsole 26 is relatively rigid in order to securely retain upper bosses 40A and 40B comprising a front boss 40A and a lower boss 40B, described below, without undue flexing. Upper midsole 26 may incorporate washer plates where the upper bosses attach, as described below. Lower midsole 28 may be less rigid, to provide more flex during wearing of the shoe and to accommodate a range of walk, running and other activities. When the shoe 10 is assembled, the upper midsole 26 and lower midsole 28 will be secured to the opposed surfaces of the insole 14 and the outsole 16, respectively, for example by adhesive.

Upper bosses 40A and 40B serve to anchor ligatures 30, as discussed below. These ligatures are under a relatively high tension and for this purpose, bosses 40 are relatively rigid and robust. The overall top to bottom height of bosses 40 is exaggerated in the drawings; in practice, upper bosses 40 as well as lower bosses 42, described below, are relatively shallow in order to provide a relatively large gap between the respective bosses. This allows the midsole to compress during use to provide shock-absorbing capabilities.

A plurality of ligatures (see FIGS. 1B, 2C and 3) of nylon, aramid, plastic-coated galvanized steel wire or other relatively inelastic high tensile strength material, connect the upper midsole 26 to the lower midsole 28. The ligatures are in two sets 30A and 30B disposed at, respectively, front portion (toe/ball 32/34) and heel portion 36 (FIG. 1A) of the upper midsole 26, i.e., at the main load-bearing portions of the sole assembly. The air bag 24 provides cushioning to absorb sudden shocks and forces, while the sets of ligatures 30A and 30B limit relative movements in certain directions between the upper midsole 26 and lower midsole 28. In particular ligatures 30 are oriented and configured to limit both horizontal displacement between the upper and lower midsoles as well as imbalanced vertical forces acting on the shoe. An example of the latter force includes a vertical compressive force that is greater on one lateral side of the shoe than the other. If unrestrained, an imbalanced vertical force can lead to excessive tilting of the shoe upper relative to the sole as the sole assembly compresses excessively on one side, while bulging upwardly on the opposing side. This can throw the user off-balance. An unrestrained horizontal displacement force, in the absence of ligatures 30, can cause bladder 24 to "roll" horizontally, leading to roll-over of the shoe. Ligatures 30 thereby enhance stability of the upper shoe body 12 relative to the outsole 16 when the shoe body 12 is subjected to lateral, longitudinal or vertical forces; or combinations thereof, relative to the outsole 16, such as might occur, for example, when the wearer suddenly stops, turns, starts to run, or jumps, or if the shoe contacts an uneven ground surface.

As can be seen from FIG. 3, the sets of ligatures 30A and 30B are joined by a longitudinal ligature 38 connecting respective upper ends of the set of ligatures 30A to those of set 30B. More particularly, as shown in FIG. 3, the first set 30A comprises four ligatures 30A/1, 30A/2, 30A/3 and 30A/4 having their respective upper ends attached securely to a frontal upper boss 40A (see also FIGS. 1B and 2D) which depends downwardly from upper midsole 26 at position 34 which, in use, would normally be beneath the ball of the wearer's foot, while the second group of ligatures 30B/1, 30B/2, 30B/3 and 30B/4 have their respective upper ends attached securely to a rearward upper boss 40B which depends in like manner from the heel portion 36 of the upper midsole 26, i.e., where the wearer's heel would normally apply pressure. The bosses 40A and 40B may be of nylon, metal or other suitable rigid material having a high tensile strength. The longitudinal ligature 38 may be made of nylon, metal or other suitable high tensile strength material, conveniently the same as that used for the two sets of ligatures.

The ligatures 30A, 30B and 38 have their upper ends connected to the corresponding ones of bosses 40B by passing the end portion through a lateral passage into an open cavity in the lower end of the boss and knotting the end portion. Alternative attachment means are possible. The upper ends of the ligatures could be attached mechanically to the boss, for example by clamps or bolts, by enlarged ends within a cavity, in the boss, the ligatures extending through holes through the walls of the boss, or moulded into the upper boss so that the upper ends are securely attached to the boss, and so on. The enlarged ends may be formed in a variety of ways, other than simple knotting the ends of the ligatures, by upsetting their respective ends while molten, especially where thermoplastic material is used, and so on. The lowermost ends of the ligature might be secured to the outsole directly, for example during moulding of the outsole, or extend through corresponding suitably placed hole in the midsole, perhaps being tied individually to the lower midsole or tied together beneath the midsole, or knotted beneath the lower midsole 28.

The longitudinal ligature 38 serves to limit longitudinal forces tending to force bosses 40A and 40B apart and, together with the set of ligatures 30A and 30B at each end of the midsole 28, help distribute forces from one part of the sole portion to another.

A corresponding pair of lower bosses 42A and 42B are formed by raised portions of the uppermost surface of lower midsole 28. When the shoe to is assembled, bosses 40A and 40B are in register with bosses 42A and 42B, respectively. Lower bosses 42A and 42 B are relatively shallow and serve primarily as wear plates to prevent wear of lower midsole 28 where this would otherwise come into contact with upper bosses 40A and B.

The upper bosses 40A and 40B are made of a light yet sturdy material, for example a thermoplastic. Depending downwardly from the upper bosses 40A and 40B are cylindrical cushioning members 46A and 46B with their respective ends aligned with, but spaced from, an upper surface of the corresponding one of the lower bosses 42A and 42B, respectively. If there is a high impact loading of the front or heel of the shoe, the corresponding one of the cushioning members 46A or 46B will contact the corresponding one of the lower bosses 42A and 42B and then will be compressed. Providing the high impact force is not excessive, the cushioning member 46A or 46B will prevent the opposed upper and lower walls of the airbag 24 from contacting and, ultimately, being squeezed together.

The cushioning members 46A and 46B may be made of a suitable cushioning material, for example a visco-elastic material such as that marketed under the trademark SORBOTHANE™ by Sorbo, Inc. of Ohio, U.S.A. When the shoe 10*o* is assembled and in use, the heel portion 36 of the shoe usually experiences greater forces and shocks than the frontal portion 32/34 so the cushioning member 46B at the heel is longer than the cushioning member 46A at the front of the shoe, can be seen from FIG. 2D and FIG. 3. It will be appreciated that the lower bosses 42A and 42B could be omitted if the corresponding area of the lower midsole 26 were strong enough, at least beneath the upper bosses 40A and 40B.

Referring also to FIGS. 2B and 3, around each of the lower bosses 42A and 42B is a corresponding set of holes 44A/1, 44A/2, 44A/3 and 44A/4 and 44B/1,44B/2, 44B/3 and 44B/4, respectively, through which respective ones of the ligatures pass. The holes in each set are spaced apart in pairs, the holes of each pair being located on either side of a centre line of the lower midsole 28, and hence spaced apart either side of the corresponding one of the lower bosses 42A and 42B. As can be seen from FIGS. 2B and 4A, the pair of holes 44A/3, 44A/4 near the toe portion 32 are closer together than the other pair of holes 44A/1, 44A/2 so each of the holes is close to the periphery of the front of the midsole 28. In like manner, and to the same effect, the pair of holes 44B/1 and 44B/2 are closer together than the pair of holes 44B/3 and 44B/4 at the heel.

Figure 4A:
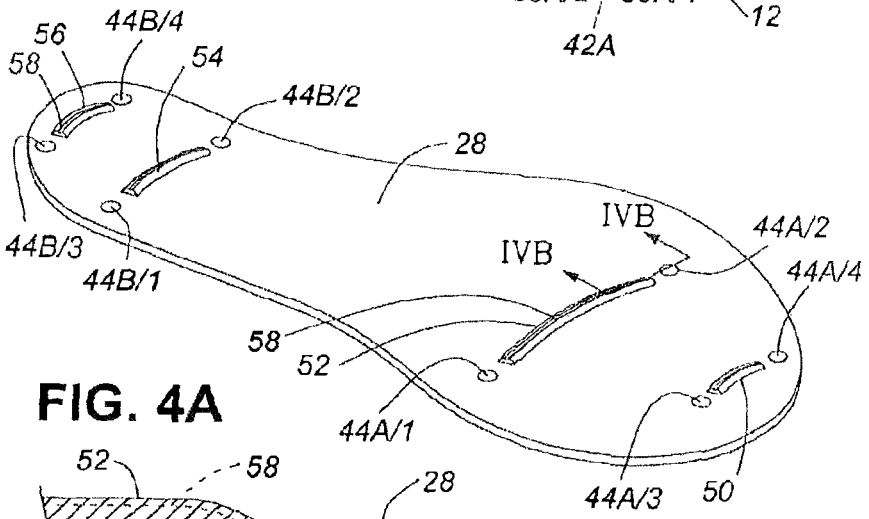
FIG. 4A is a plan view from beneath of the lower midsole
Figure 4B:
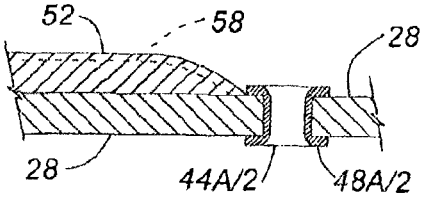
FIG. 4B is a cross-sectional side view of a portion of the lower midsole along the line IVB-IVB of FIG. 4A.

Each one of the holes 44A/1-44A/4 and 44B/1-44B/4 contains a respective one of two sets of eyelets 48 (see FIG. 4B). Other eyelets are not shown for convenience of illustration. Each of the ligatures has first free end securely anchored to the corresponding one of upper bosses 40A and 40B. The ligature then passes downwards through one of the eyelets of a pair, across the underside of the lower midsole 28, upwards through the other of the pair of eyelets and back to the same one of the bosses 40A and 40B. The opposing free end is anchored at the same boss as the first free end. Where it passes along the underside of the lower midsole 28, the ligature is secured to the undersurface of the lower midsole 28, for example by adhesive. Each ligature is thus configured generally as a triangle, with a narrow apex at the boss where the free ends are anchored, and a broad base where the ligature passes underneath the lower midsole. Opposing portions of each ligature slope downwardly and outwardly from the central boss towards the periphery of the sole assembly. The triangular configuration, retained under tension, allows each ligature can withstand the severe forces tending to move the insole 14/upper midsole 26 relative to the outsole 16/lower midsole 28 during use.

Figure 4C:
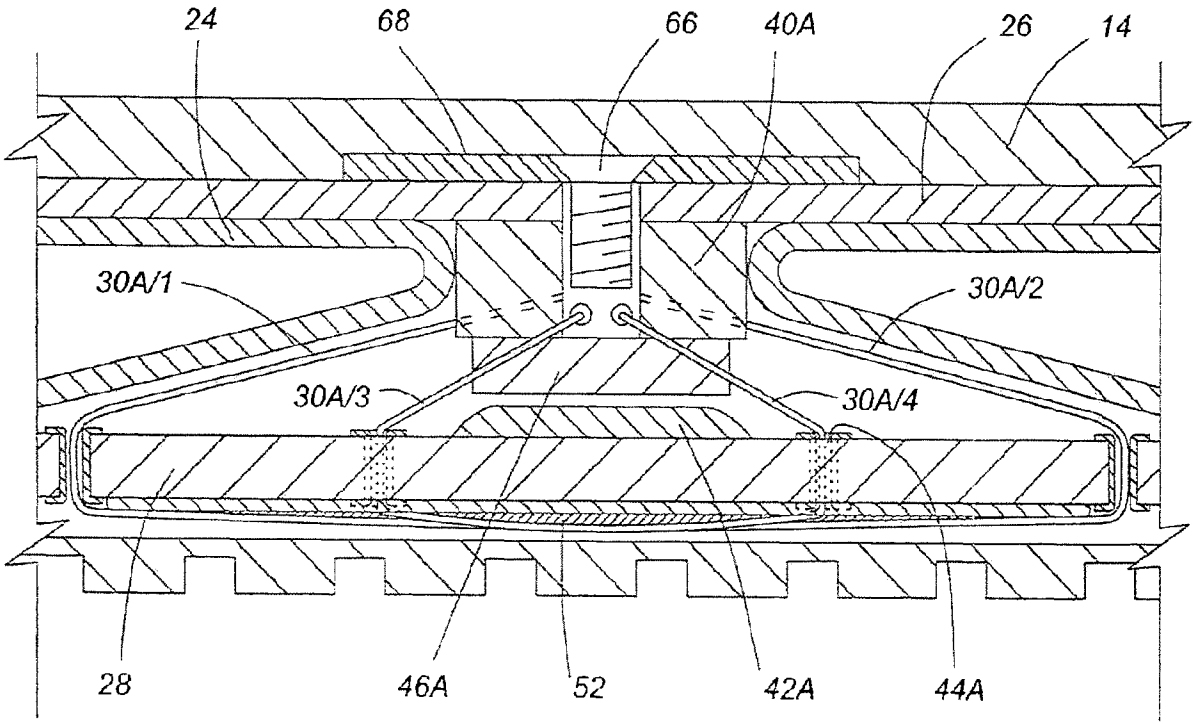
FIG. 4C is a partial cross-sectional view of the insole, cushioning section and outsole on the line IV-IV of FIG. 3 with the air bag partially compressed.

In order to avoid sharp bends in each ligature as it passes through the corresponding eyelet, and to improve the strength of its attachment to the lower midsole 28, each ligature passes over a curved rib extending across the midsole between the pair of holes/eyelets. Thus, as shown in FIGS. 4A, 4B and 4C, a series of four ribs 50, 52, 54 and 56 are provided on the underside of midsole 28. Each rib extends between a corresponding pair of the holes/eyelets and its outer edges curves convexly away from the midsole 28. The outer edge of each rib is grooved (see FIG. 4B, reference 58) to engage the ligature and prevent it from slipping off the rib.

It is envisaged that each ligature in sets 30A and 30B may extend unbroken beneath the lower midsole 28, through the eyelets 48A/48B, through channels in the air bag 24, and across and through the corresponding one of upper bosses 40A and 40B. Accordingly, the opposing ends of each of these ligatures are both anchored in the upper bosses 40.

It is also envisaged that, to avoid abrasion of the ligature by sharp bending at the eyelet, a curved rib may be provided between the eyelets of each pair so that the ligature curves more gently as it passes through the eyelet at its underside. Thus, as shown in FIG. 4C, which shows the sole section when the force on the insole/midsole has compressed the air bag partially, the lower midsole 28 a series of curved raised ribs 50, 52 and 54 extend across the lowermost surface of the lower midsole 28 so that each of the ribs 50, 52 and 54 conjoins a corresponding pair of the eyelets. The curved surface of each of the ribs 50, 52 and 54 has a groove 58 to receive the ligature and ensure that it does not slip off the rib. The bottom face of lower midsole 28 where the ribs are connected thereto can be co-moulded with tread 22 thereby binding the ligatures and ribs together more or less permanently. The curvature of each rib 50, 52 and 54, is such that lateral forces applied to the insole 20/upper midsole 26 will be resisted not only by the eyelet but will be distributed by the rib across the width of the lower midsole 28 and coupled to the ligatures at the opposite side. When the shoe is assembled, the ribs 50, 52 and 54 will fit into complementary slots 50A, 52A, 54A and 54B (see FIG. 2A), respectively, in the uppermost surface A outsole 16, clamping the corresponding ligature in the slot. Adhesive may also be used to retain the ligature and the rib in the slot. The longitudinal forces may be distributed in a similar manner by the ligature 38 conjoining upper bosses 40A and 40B.

The main cushioning, however, is provided by bladder or air bag 24 between the upper midsole 26 and the lower midsole 28. Like a football or basketball or the like, the air bag 24 has a rugged outer of soft synthetic rubber or the like and an inflatable internal bladder of butyl rubber, for example. For convenience of illustration, however, the internal bladder is not shown. References to air bag 24, therefore, should be taken as referring to the assembly of internal and external bladder layers.

Referring to FIGS. 2C, 3, 5A and 5B, a valve 60 at the rear end of air bag 24 allows the internal bladder (not shown) to be inflated to an appropriate pressure. The valve 60 may be of conventional form such as those used for insertion of a needle, as in the case of a football or basketball, or a mechanical valve of the kind used to inflate some bicycle tires having a moveable valve body seated within a valve bore. As can be seen from FIG. 5A, the height W2 of the air bag 24 at the heel portion 36 is slightly deeper than the height W1 the front portion 32/34 for the same reason that the heel cushioning member 46 is longer than the front cushioning member 46A.

Figure 5A:
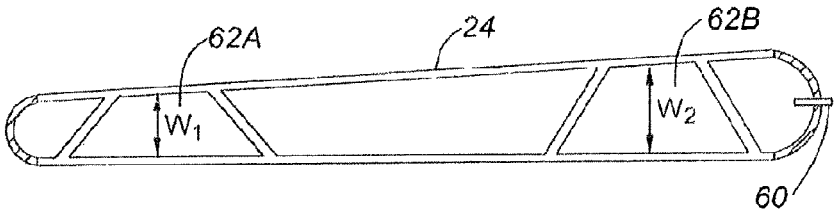
FIG. 5A is a longitudinal cross-sectional view on the centre-line of the air bag of FIG. 2C and FIG. 3.
Figure 5B:
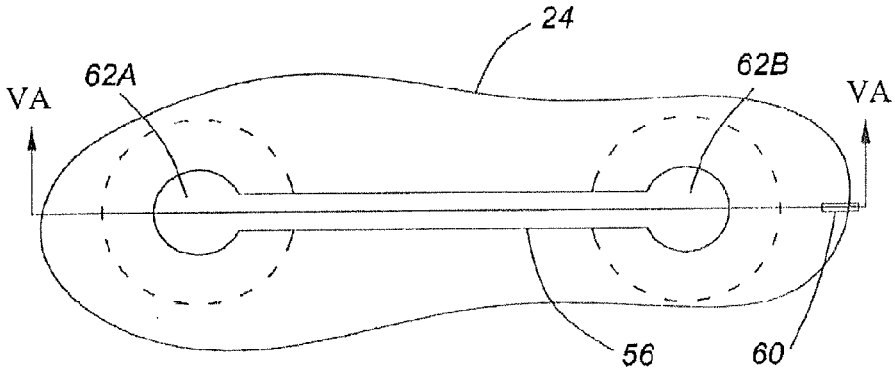
FIG. 5B is a plan view of the airbag of FIGS. 2C and 3.

Referring to FIGS. 2C, 5A and 5B, air bag 24 has a rear through hole or void 62B at its heel portion aligned with the upper heel boss 40B depending from the upper midsole 26 and a front through hole 62A aligned with the upper front boss 40A of the upper midsole 26. Each of the through holes 62A and 62B is shaped as a truncated cone and is sized to allow the corresponding one of the bosses 40A and 40B and the attached ligatures to pass through it without contact so as to avoid chafing. Each of the holes 62A and 62B also might have a protective lining (not shown) for protection against chafing if there is movement of the air bag 24 relative to the bosses 40A, 40B and the ligatures. Optionally, the interior of each of the conical holes 62A and 62B through the air bag 24 could have grooves, the upper ends of which are indicated in FIG. 5B, to provide clearance for the ligatures. Such grooves might allow the holes 62A and 62B to be smaller in diameter.

It is noted, however, that an air bag 24 without grooves might be easier to make than an air bag 24 with grooves.

As can be seen from FIGS. 1B, 5A and 5B, the through holes 62A and 62B are conjoined by a longitudinal slot 64 which extends along the length of the air bag 24, between the front boss 40A and the rear boss 40B. The longitudinal slot 64 divides the instep portion of the air bag 24 into two halves, and allows space for the longitudinal ligature 38 to interconnect the front boss 40A and heel boss 40B. The longitudinal ligature 38 couples part of the force applied to one set of ligatures 30A/30B to the other set of ligatures, especially when the force has a significant longitudinal component.

Thus, the two sets 30A and 30B of ligatures, together with the longitudinal ligature 38, are disposed so as to stabilize the upper midsole 26 and lower midsole 28 as they are subjected to forces in several dimensions tending to force them apart. Ligatures 30A and 30B are angled radially outwardly towards the front and rear respectively of the shoe. The respective sets of ligatures do not radiate towards each other, so as to leave an essentially uninterrupted space in the middle portion of cushioning section 18 for airbag 24.

As compared with previously known shoes, the embodiment of the invention described hereinbefore generally allows the shoe upper 12 to "float" relatively freely and without immediate obstruction on a cushion of air provided by the air bag 24. Moreover, the combination of an air bag 24 and a system of internal ligatures 30A/30B/38 for stabilization may further allow a shoe embodying the present invention to be self-leveling with traction control capabilities because the upper midsole 26 (and insole) may tilt relative to the lower midsole 28 and outsole 16 as the wearer stops, starts or corners. Because the upper shoe body 12 may tilt relative to the outsole 16, compared to a conventional shoe, more of the undersurface of the outsole 16 may remain in contact with the ground when the wearer is changing direction, giving better traction.

The upper bosses 40A and 40B may be attached to the upper midsole 26 by screws 66. The area around the holes through which the screws pass may be reinforced, perhaps by washer 68, thickening of the midsole/insole material and/or use of additional or other materials. The eyelets 48A/48B may take the usual form used for laces.

As mentioned, the underside of the lower midsole 28, with the curved ribs, may be glued to the uppermost surface of the outsole 16, perhaps located in recesses in the uppermost surface of the outsole 16, or, if preferred, secured to it during moulding of the outsole 16. The outsole will usually be made of rubber but the midsole 28 will usually be rigid as compared with the outsole 16 because it must transfer forces from one part of the midsole 28 to another.

The upper midsole may be integral with the insole, possibly with the upper boss secured thereto during manufacture, in which case the washer might be dispensed with and the insole/upper midsole suitably reinforced.

Likewise, the lower midsole may be integral with the outsole. The stops/lower bosses and ribs may be integral too, for example by being integrally formed during manufacture such as during a moulding process. The lower segments of the ligatures can be embedded at the same time.

Although the above-described embodiment has an air bag/bladder filled with air, it will be appreciated that it could be filled with other fluids, including gases such as nitrogen or helium, alone or in a mixture, and it is envisaged that the fluid might comprise a combination of liquids and gases. It is also envisaged that the air bag might comprise several compartments or comprise a closed-cell foam or other material having a multiplicity of bubbles filled with air or one of the other fluids mentioned hereinbefore. For example, the cushioning assembly may comprise a resilient foam material and the ligatures may pass through channels within the foam.

To inhibit stretching of the material of the sidewalls 20 of the upper body 12, they may be reinforced with filaments of nylon or other synthetic materials, possibly formed by spinning and twisting fibers, adhered to the surface of the sidewall or embedded into it, as disclosed, for example, in US patent document number 2013/0025075.

It is also envisaged that, instead of the ligatures passing across the undersole of the lower midsole 26, they could be embedded in it or lower ends of the ligatures may be anchored in the lower misole 26.

Although shoe 10 described herein has an upper midsole 26 and lower midsole 28 separate from the midsole 26 and outsole 16, respectively, i.e. the air bag 24 is attached indirectly to the insole 26 and outsole 16, it will be appreciated that the air bag 24 could be attached directly to either or both of the insole 26 and outsole 16. Thus, either or both of the upper midsole 26 and lower midsole 28 could be omitted and their respective features and functions provided by the insole 20 and outsole 16, respectively, suitably adapted as required. It should be noted that, although the foregoing description is concerned primarily with shoes worn during strenuous activities, embodiments of the invention may be particularly useful for people having structural problems with their feet, especially requiring orthopedic or pedorthic/podiatric solutions. They may also provide a "bounce" effect as desired in some new sports and leisure activities.

Each ligature may take the form of a continuous loop having an upper segment passing through a transverse hole in the upper boss and a lower segment passing across the 15 midsole, conveniently through mutually spaced holes in the lower midsole.

Figure 6:
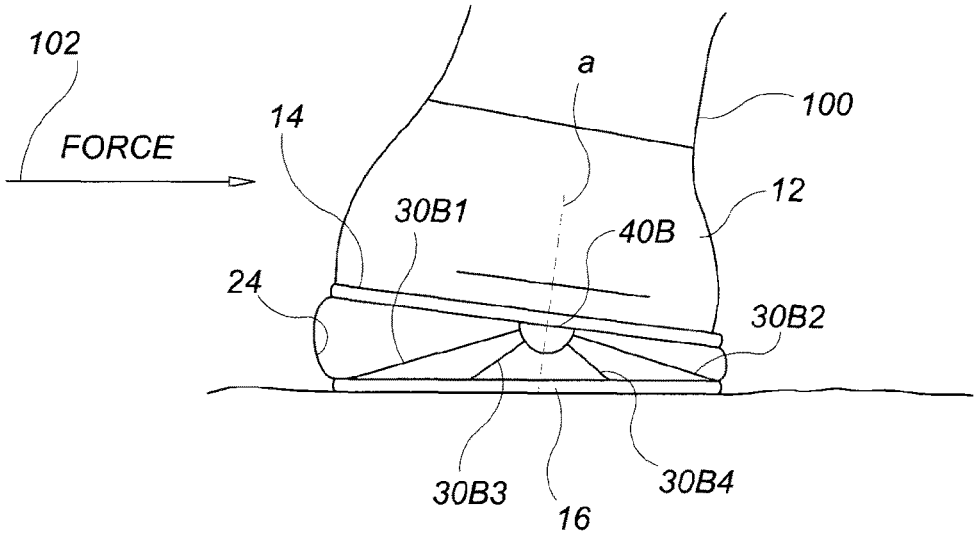
FIG. 6 is a schematic view showing a partial transverse cross section of a shoe according to the present invention, with a lateral horizontal force applied thereto.
Figure 7:
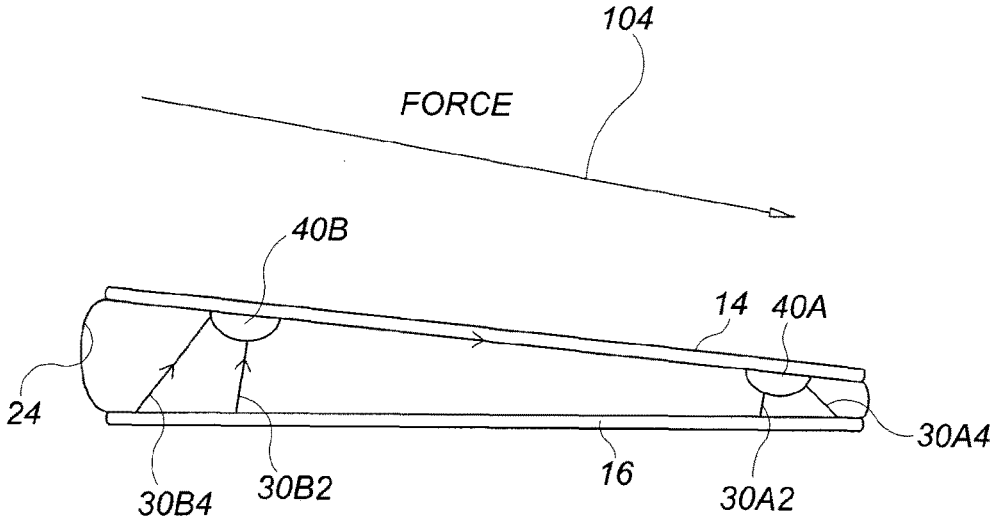
FIG. 7 is a schematic view showing a partial longitudinal cross section of a shoe according to the present invention, with an axial horizontal force applied thereto.

FIGS. 6 and 7 schematically illustrate the present invention in use in a shoe in which lateral or axial forces are applied to the shoe. In the case of FIG. 6, a user's foot 100 is shown wearing a shoe 10 according to the invention. An essentially vertical axis a is shown which equally bisects the shoe in a plane that defines the central longitudinal axis of the shoe. A lateral force 102 is applied against shoe 10, indicated by arrow 102. Lateral force 102 may be generated by a user-applied force such as acceleration around a curve or a sudden change of direction, or a force generated by contact of the shoe with a sloping surface. Lateral force 102 will tend to compress air bladder 24 at the side of the shoe facing away from direction of force, tending to tilt the shoe away from the direction of force and/or to laterally displace sole 16 relative to upper 12, tending to cause roll-over of the shoe. These tilting and displacement effects are reduced by the downwardly/outwardly angled ligatures 30. As seen in FIG. 6, rear ligatures 30B/1 and 30B/3 are located on the lateral side of the shoe on one side of axis facing towards force 102 where these ligatures will tend to counteract any tilt and/or displacement of upper 12 relative to sole 16. As a result, force 102 will tend to tension ligatures 30B/1 and 30B/3 located on the side of axis a facing force 102. Ligatures 30B/2 and 30B/4, located on the opposing side of axis a facing away from force 102, are relatively detensioned.

A similar tensioning/detensioning effect is generated in the front ligatures 30A.

It will be seen that the degree of tilt of upper 12 and resulting compression of air bladder 24 is exaggerated for clarity in FIG. 6.

FIG. 7 shows a similar stabilizing effect in the fore/aft (axial) direction, wherein a force 104 is applied in the forward (axial) direction. This generates a destabilizing fore/aft force, which is counteracted by rearward ligatures 30B which are placed under tension. In FIG. 7, only ligatures 30B/2 and 30B/4 are shown for simplicity but it will be understood that all of the rearward ligatures 30B are placed under tension by the forward/upward displacement occurring at the rear of the shoe.

It will thus be seen that the ligatures 30 are oriented to improve stability of the shoe when a lateral or axial force is applied to the shoe, or any combination thereof including a force with a vertical component, such as a force having both a horizontal and vertical component, or a vertical force which is unequally applied to the shoe. However, if the force is applied in substantially vertical direction and is generally equally applied to the shoe, such as a normal force during jumping or straight-line running, the ligatures will have minimal interference with the normal compression of bladder 24 thereby permitting the bladder to absorb shock.

Ligatures 30 are securely anchored at their upper ends to minimize the risk of de-anchoring during use. As well, ligatures 30 have sufficient tensile strength to minimize the risk of rupture during use.

Preferably, ligatures 30 are tensioned to a relatively high degree. The exact tension of ligatures 30 will depend in part on the properties of cushioning section 18. For example, the tension of ligatures 30 may be increased with a less-compressive cushioning section that may be provided with a high-pressure air bladder and/or a relatively large air volume. If the bladder is more easily compressed, for example if the pressure therein is lower and/or the bladder has a smaller volume, the ligatures may be set at a somewhat lower tension to prevent over-compression of the bladder.

The anchoring locations, as well as the angles at which ligatures 30 are disposed, can be readily selected to provide a useful stabilizing effect. At least some of ligatures 30 should radiate outwardly in a direction which is close to perpendicular to axis a, in a vertical plane, to provide maximal lateral stability, while others of ligatures 30 should be close to co-axial in a vertical plane, to provide fore/aft stability. Preferably, others of ligatures 30 are intermediate between co-axial and perpendicular to axis a. Furthermore, ligatures 40 angle downwardly from their upper anchors at bosses 62 to their lower anchoring point at plate 16. Preferably, ligatures 30 should splay outwardly as much as possible towards the periphery of the shoe to increase their stabilizing effect.

Figure 8:
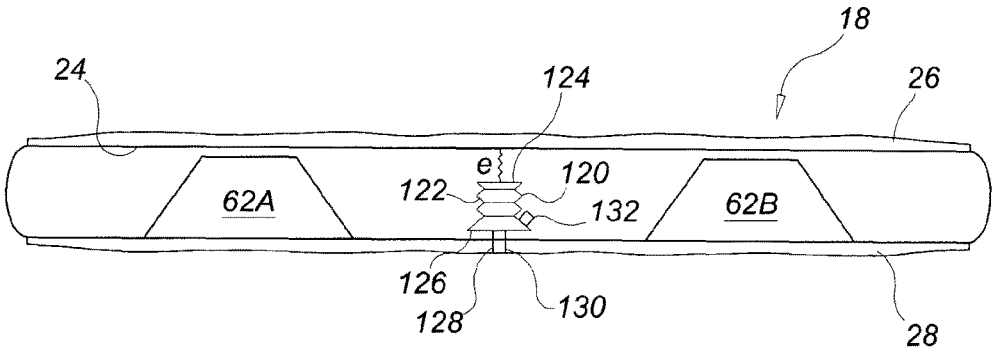
FIG. 8 is a cross-sectional view as in FIG. 1B, showing an alternative embodiment.
Figure 9:
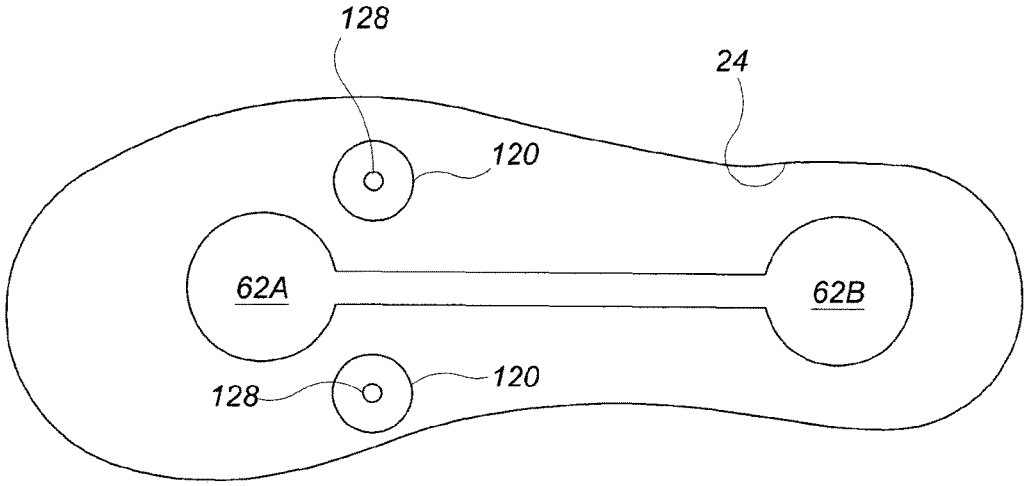
FIG. 9 is a bottom plan view of the insole, showing internal structure, of the embodiment of FIG. 8.
Figure 10:
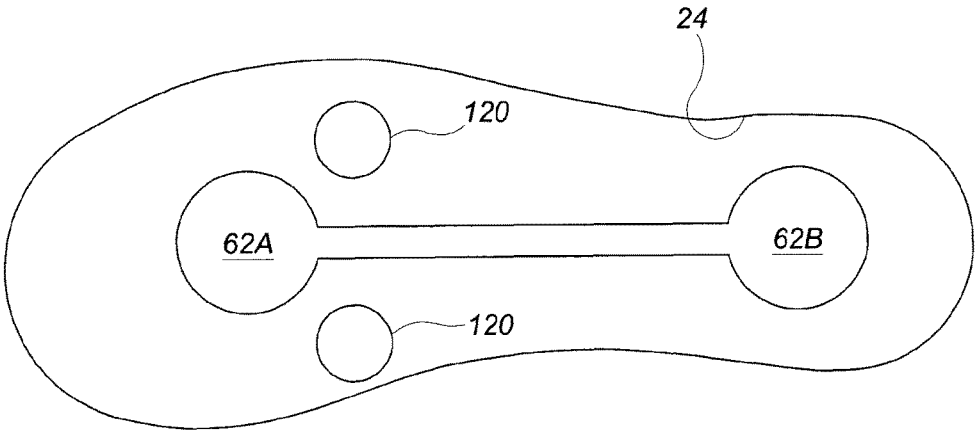
FIG. 10 is a top plan view of the insole, showing internal structure, of the embodiment of FIG. 8.

FIGS. 8 through 10 illustrate a further embodiment wherein an internal air pump 120 is provided to maintain air pressure within bladder 24. Pump 120 counteracts slow leakages that can occur with an air bladder. Further, since bladder 24 is maintained in a pumped-up condition by pump 120 during use, it becomes possible to fabricate bladder 24 from a thinner material which is lighter and more flexible than conventional shoe bladder materials, thereby improving the performance of the shoe. As well, a higher pressure within bladder 24 permits ligatures 30 to be placed under a higher tension, thereby improving their performance.

According to this embodiment, cushioning section 18 comprises upper and lower midsoles 26 and 28 which sandwich bladder 24. Optionally, bladder 24 is shaped to form voids 62*a* and 62*b*. Air pump 120 is attached to the floor of bladder 24, between voids 62*a* and 62*b* if these are present. Since pump 120 operates by absorbing compressive forces applied to cushioning section 18, it can be preferable to locate pump 120 towards the rear of section 18 where compressive forces tend to be more concentrated.

Pump 120 comprises a flexible tubular body having an accordion-shaped sidewall 122 that allows pump 120 to expand and contract vertically to provide a pumping action when compressed and flat upper and lower walls 124 and 126. Sidewall 122 provides a spring-biasing effect wherein a relaxed position extends pump 120 to its full height. As a result, when pump 120 is forcibly compressed, sidewall 122 is urged into its compressed state. When the compressive force is removed, sidewall 122 urges the pump into its fully extended position, thereby forceably drawing air into its interior. An inlet valve 128 extends downwardly from lower wall 126 and communicates with the interior of pump 120. Valve 128 extends downwardly through an opening 130 within lower midsole 28. The lower (intake) opening of valve 128 communicates with an opening within the show outsole, not shown, to allow air to enter valve 128 from the lower surface of the show.

Preferably, valve 128 is cemented or otherwise securely anchored in place within opening 130 to anchor pump 120 to midsole 28. An outlet valve 132 discharges air into the interior of bladder 24 when pump 120 operates.

In operation, when bladder 24 is sufficiently compressed during use of the shoe, upper midsole 26 contacts upper wall 124 of pump 120 and drives it downwardly, thereby discharging air into bladder 24 through outlet valve 132. During the decompression stage of bladder 24, pump 120 expands lengthwise vertically thereby drawing in air through inlet valve 128.

Valves 128 and 132 are one-way valves that permit air to flow into or out of pump 120 respectively. Either or both of valves 128 or 132 may be calibrated to provided a maximal air pressure differential between the ambient air outside the shoe and bladder 24, to avoid exceeding a predetermined maximum air pressure within bladder 24.

In one embodiment, top wall 124 of pump 120 is spaced from upper midsole 28 by a gap "e" which allows bladder 24 to freely compress for this distance before contacting pump 120. The spacing of gap e may be selected depending on the parameters of the bladder and the shoe, for example the overall top to bottom height of bladder 24, the maximum air pressure therein and other parameters. In another option, not show, pump 24 extends the full height of bladder 24.

As shown in FIGS. 9 and 10, two pumps 120 may be provided alongside the central axis of the shoe. In alternative embodiments, now shown, either a single pump may be provided at preferably a location at or near the central axis or more than two pumps 120 may be provided within each shoe.

INDUSTRIAL APPLICABILITY

Apart from providing comfort and resilience, as required of any shoe, especially for sports, athletics and other strenuous activities, a feature of shoes embodying the present invention is the ability of the insole/upper midsole to "float" relative to the outsole leading to improved traction since more of the lowermost surface of the outsole may remain in contact with the ground when the wearer changes direction, especially laterally. The air bag and ligature tethering arrangement may also allow self-leveling of the insole relative to the outsole. This is particularly helpful when the shoes are sports shoes used, for example, by athletes who subject them to heavy loading.

The combination of an air bag between the insole and outsole and ligatures tethering them provides for good cushioning and stability.

Although an embodiment of the invention has been described and illustrated in detail, it is to be clearly understood that the same is by way of illustration and example only and not to be taken by way of limitation, the scope of the present invention being limited only by the appended claims.

The invention claimed is:

1. A shoe sole assembly having a front toe end, a rear heel end and lateral sides with a central axis extending between the front and rear ends, the sole assembly comprising an outsole having a lower surface for contacting the ground, an insole and cushioning between the insole and the outsole, the sole assembly further comprising a plurality of ligatures interconnecting the insole and the outsole, respectively, by way of the cushioning section, the ligatures being tensioned and angularly oriented to the central axis to control movement of an upper connected to the outsole; wherein the insole further comprising a downwardly-extending upper boss depending from the insole, and wherein at least one of said ligatures is anchored to said upper boss.

2. The shoe sole assembly of claim 1 wherein at least one of said ligatures extends through said cushioning.

3. The shoe sole assembly of claim 1, wherein the cushioning comprises a gas bladder.

4. The shoe sole assembly of claim 1, further comprising an upwardly-extending lower boss aligned with and opposing said upper boss and spaced apart therefrom configured to act as a stop member for the upper boss when the cushioning is compressed.

5. The shoe sole assembly of claim 1, wherein at least one of said ligatures comprises a continuous member wherein opposing free ends of said ligature are anchored adjacent to the insole and a middle portion of said ligature passes beneath said cushioning section.

6. The shoe sole assembly of claim 5, wherein the free ends of said ligature are anchored to said upper boss.

7. The shoe sole assembly of claim 4, wherein the upper boss comprises a shock absorber extension projecting downwardly to contact the corresponding lower boss when vertical loading is applied to the shoe, said shock absorber being configured to limit compression of said cushioning section.

8. The shoe sole assembly of claim 5, further comprising a rib extending across a lower surface of said cushioning section having a downwardly-facing surface for contacting said ligature and configured to retain the middle portion of the ligature beneath said cushioning section.

9. The shoe sole assembly of claim 1, wherein the plurality of ligatures comprise a first ligature adjacent to said toe and a second ligature adjacent to said heel.

10. The shoe sole assembly of claim 1, wherein at least one of said ligatures is oriented to angle outwardly and downwardly from an upper anchoring location adjacent to said central axis to a lower engagement location adjacent to an outer edge of said sole assembly.

11. The shoe sole assembly of claim 1, wherein at least one of said ligatures extends substantially longitudinally between the front and rear ends of said shoe.

12. The shoe sole assembly of claim 1, wherein at least two of said ligatures extend in opposing directions substantially perpendicular to said central axis.

13. The shoe sole assembly of claim 1, wherein at least one of said ligatures is oriented in a direction intermediate between perpendicular and parallel to said central axis.

14. The shoe sole assembly of claim 1, wherein said ligatures comprise two sets of ligatures wherein a first of said sets comprises ligatures that are anchored at or adjacent to the widest portion of the front of said shoe and a second of said sets is anchored at or adjacent to the widest portion of the rear of said shoe.

15. The shoe sole assembly of claim 1, wherein said ligatures are angularly disposed to resist lateral displacement forces acting between the upper and sole of the shoe and unbalanced vertical compressive forces acting on said shoe.

16. The shoe sole assembly of claim 1, wherein the cushion comprises an air bladder, and shoe sole assembly comprises a pump for pressurizing said air bladder, wherein said pump is configured to introduce air into said air bladder upon compression of said sole section.

17. The shoe sole assembly of claim 16, wherein said pump is positioned within the interior of said air bladder and comprises an air inlet extending to the exterior of said sole assembly, an outlet opening into the interior of said air bladder, and a one-way valve within at least one of said inlet and outlet for admitting air into said air bladder while preventing release of air from said air bladder.

18. The shoe sole assembly of claim 17, wherein said pump is anchored to a lower portion of said air bladder and extends upwardly within said bladder, wherein a gap is defined between an uppermost surface of said pump when fully extended and an upper layer of said bladder.

19. A shoe comprising an upper and the shoe sole assembly of claim 1.

* * * * *